US007766287B2

(12) United States Patent
Marino

(10) Patent No.: US 7,766,287 B2
(45) Date of Patent: Aug. 3, 2010

(54) BRUSH HOLDER

(75) Inventor: Frank Marino, Baldwin, NY (US)

(73) Assignee: Linzer Products Corp., Wyandanch, NY (US)

( * ) Notice: Subject to any disclaimer, the term of this patent is extended or adjusted under 35 U.S.C. 154(b) by 0 days.

(21) Appl. No.: 12/248,486

(22) Filed: Oct. 9, 2008

(65) Prior Publication Data

US 2009/0256033 A1 Oct. 15, 2009

Related U.S. Application Data

(63) Continuation-in-part of application No. 29/306,426, filed on Apr. 9, 2008, now Pat. No. Des. 611,713.

(51) Int. Cl.
*A46B 17/02* (2006.01)

(52) U.S. Cl. ..... 248/110; 248/316.7; 15/257.01

(58) Field of Classification Search ..... 248/110, 248/113, 316.1, 316.7; 15/257.01, 246, 268, 15/264

See application file for complete search history.

(56) References Cited

U.S. PATENT DOCUMENTS

| | | | | |
|---|---|---|---|---|
| 1,551,243 | A * | 8/1925 | Dick | 248/210 |
| 2,855,123 | A * | 10/1958 | Kintz | 220/736 |
| 3,874,021 | A * | 4/1975 | Jacobs | 15/202 |
| 6,419,194 | B1 * | 7/2002 | LoSacco et al. | 248/113 |
| 6,871,825 | B2 * | 3/2005 | Song | 248/113 |
| 6,929,225 | B1 * | 8/2005 | Kent | 248/213.2 |
| 7,194,786 | B2 * | 3/2007 | Gagne | 16/406 |

* cited by examiner

*Primary Examiner*—A. Joseph Wujciak, III
(74) *Attorney, Agent, or Firm*—Collen IP; Donald J. Ranft

(57) ABSTRACT

A brush holder designed to hold brushes used to apply liquid coverings to surfaces. The holder is securely attached to the brush. The holder allows the brush to then be supported form the top of the liquid container. The holder further allows the distance between the brush and the container surface to be adjusted as required.

2 Claims, 5 Drawing Sheets

BRUSH HOLDER

This is a continuation-in-part of application Ser. No. 29/306,426, filed Apr. 9, 2008, now U.S. Pat. No. Des. 611, 713.

BACKGROUND

One of the challenges when applying liquid coatings such as paint or stain using a brush is what to do with it between its uses while applying the liquid. Laying the brush down often allows the covering liquid to accumulate higher up in the bristles and on the bristle holding mechanism and handles. This can cause problems when reused and certainly adds to the required time to clean the brush for future use. Numerous devices exist to support a brush in between uses. These all focus on attachments to the liquid container or other related devices. Many require the use of 2 hands to attach the brush to the container and often the attachment is unstable occasionally resulting in dropping of the brush.

SUMMARY

This disclosure describes a device designed to hold a brush from a container. The attachment device is securely attached to the brush. Once attached to the brush the combination provides a space between itself and the brush to allow it to straddle a paint liquid container from which the brush is to be supported.

DETAILED DESCRIPTION

Figure 1:
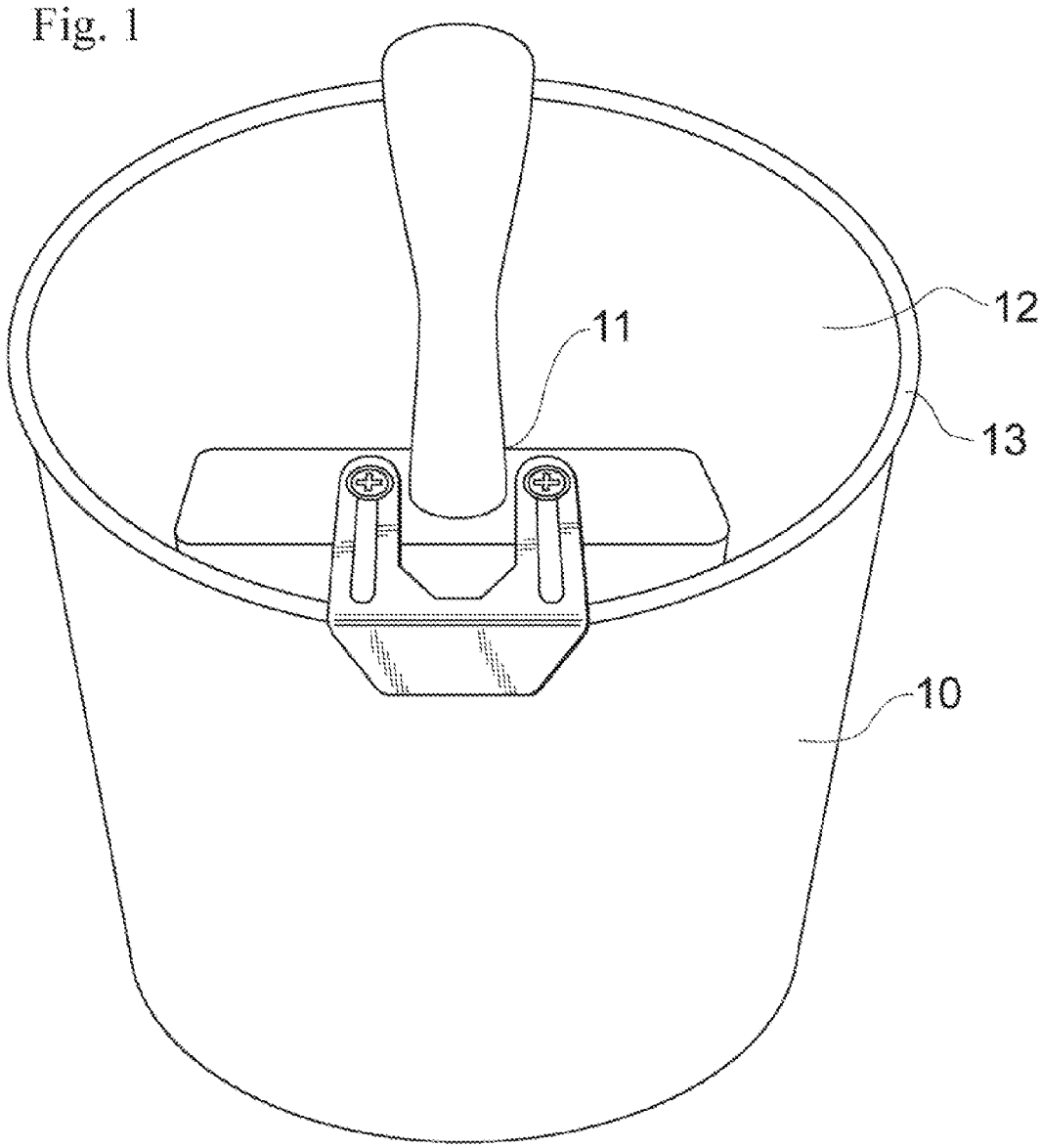
FIG. 1 is a perspective view of a brush holder in accordance with this invention attached to a brush and supported inside a paint container.
Figure 2:
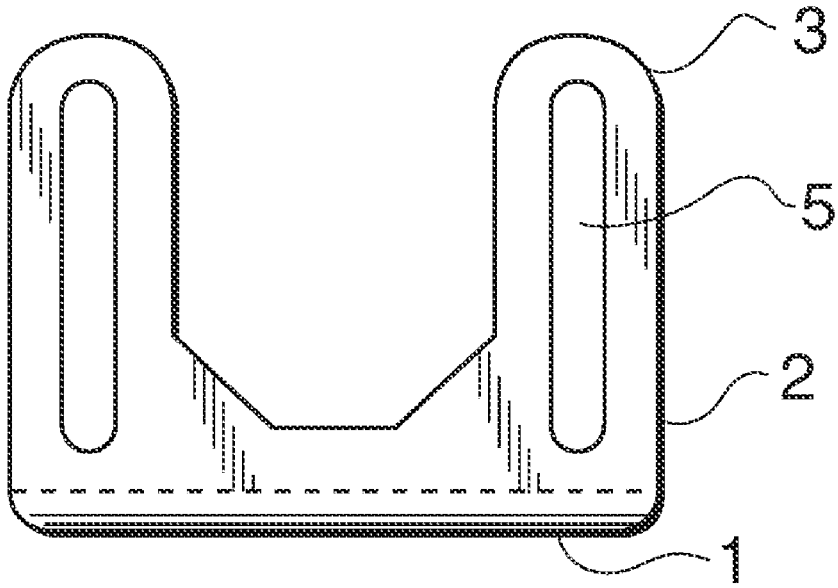
FIG. 2 is a top plan view of a brush holder in accordance with this invention.
Figure 3:
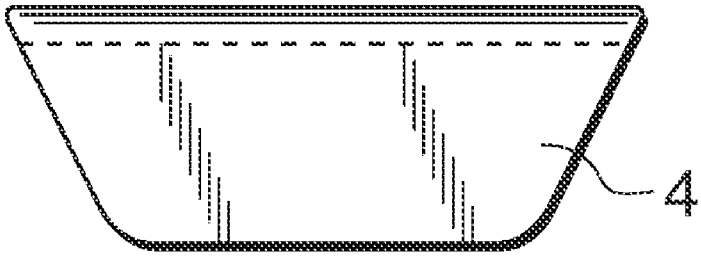
FIG. 3 is a front plan view of a brush holder in accordance with this invention.

Referring to the drawings, the brush holder (1) consists of a generally flat upper portion (2) with two brush attachment arms (3) extending from it at one end. The brush holder has a front portion (4) which is bent downward at typically a 90 degree angle from its upper portion. The distance between the brush attachment arms (3) is determined based on the width of the brush handle (6) for which it is intended for use.

The upper portion (2) is typically designed to be attached a brush's bristle holding mechanism (7) typically via screws (8). Each brush attachment arm (3) has a slot (5) through which the screws are inserted. This allows for adjusting the space between the bristle holding mechanism and the front portion (4) of the brush holder (1) depending on the container (10) from which the paint brush (11) is to be supported. In another embodiment binder clip (13) supported from the slots on the brush are utilized in lieu of screws to attach to the brush handle.

Figure 4:
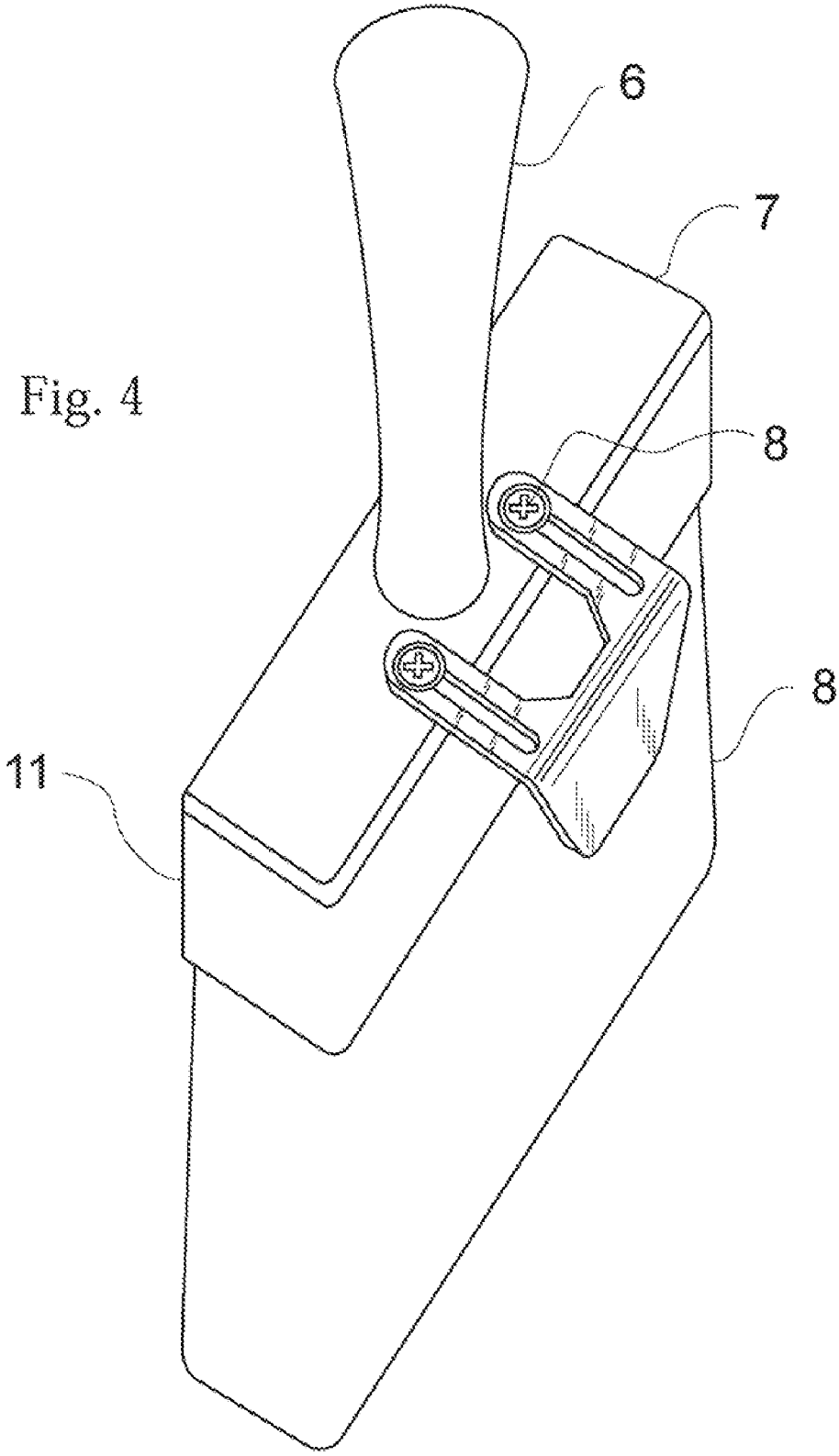
FIG. 4 is a perspective view of a brush holder in accordance with this invention attached to a brush.

As depicted on FIG. 4, with the brush holder (1) attached to a paint brush (11) the brush can be inserted into an opening (9) in the container (10) while not actively being used. The upper portion (2) of the brush holder (1) rests on a rim (12) on the top of the container (10) with the front portion (4) of the brush holder (1) pressing against the outside of the container (10). The holder can also be utilized to support the brush hanging outside the container.

Figure 5:
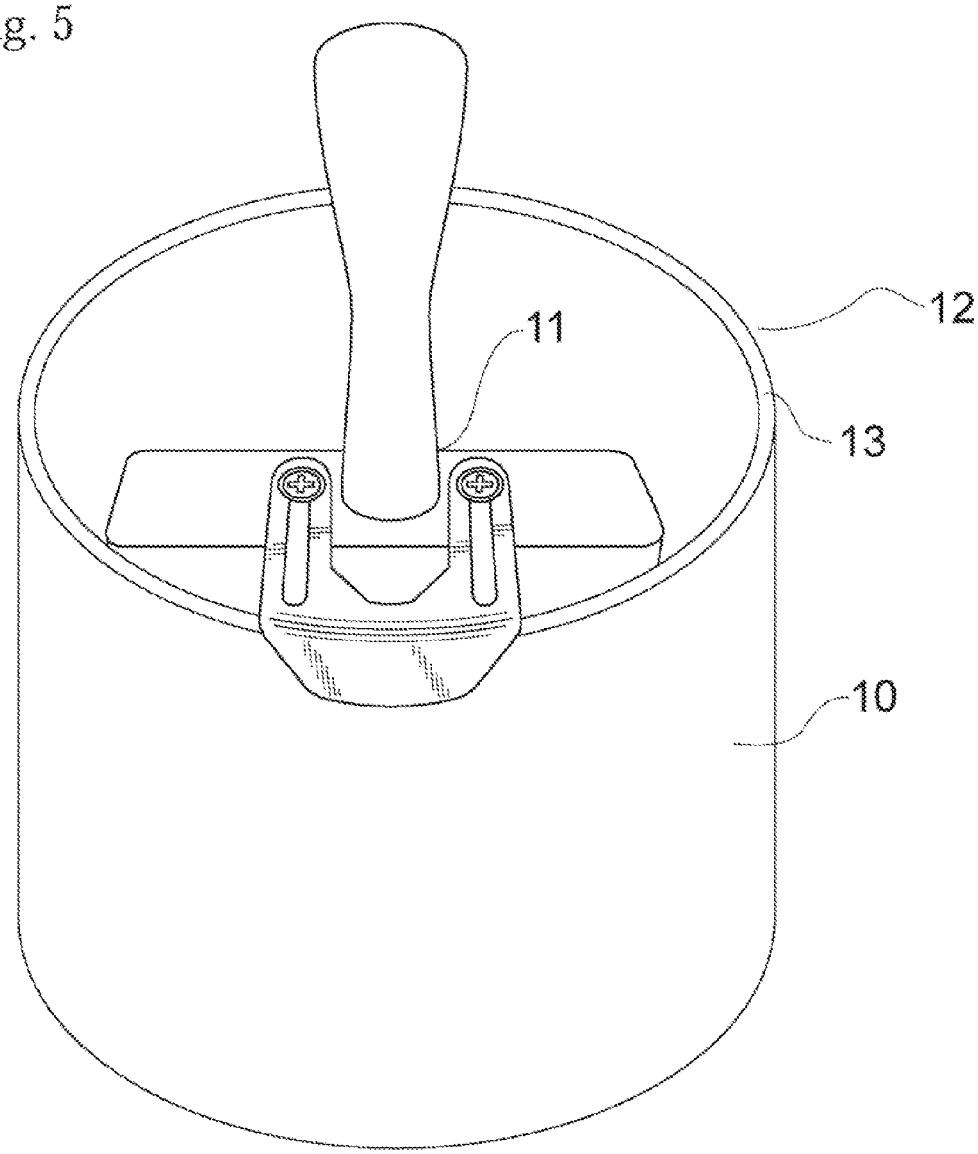
FIG. 5 is another embodiment of a perspective view of a brush holder with an arc on the front portion in accordance with this invention attached to a brush and supported inside a paint container.
Figure 6:
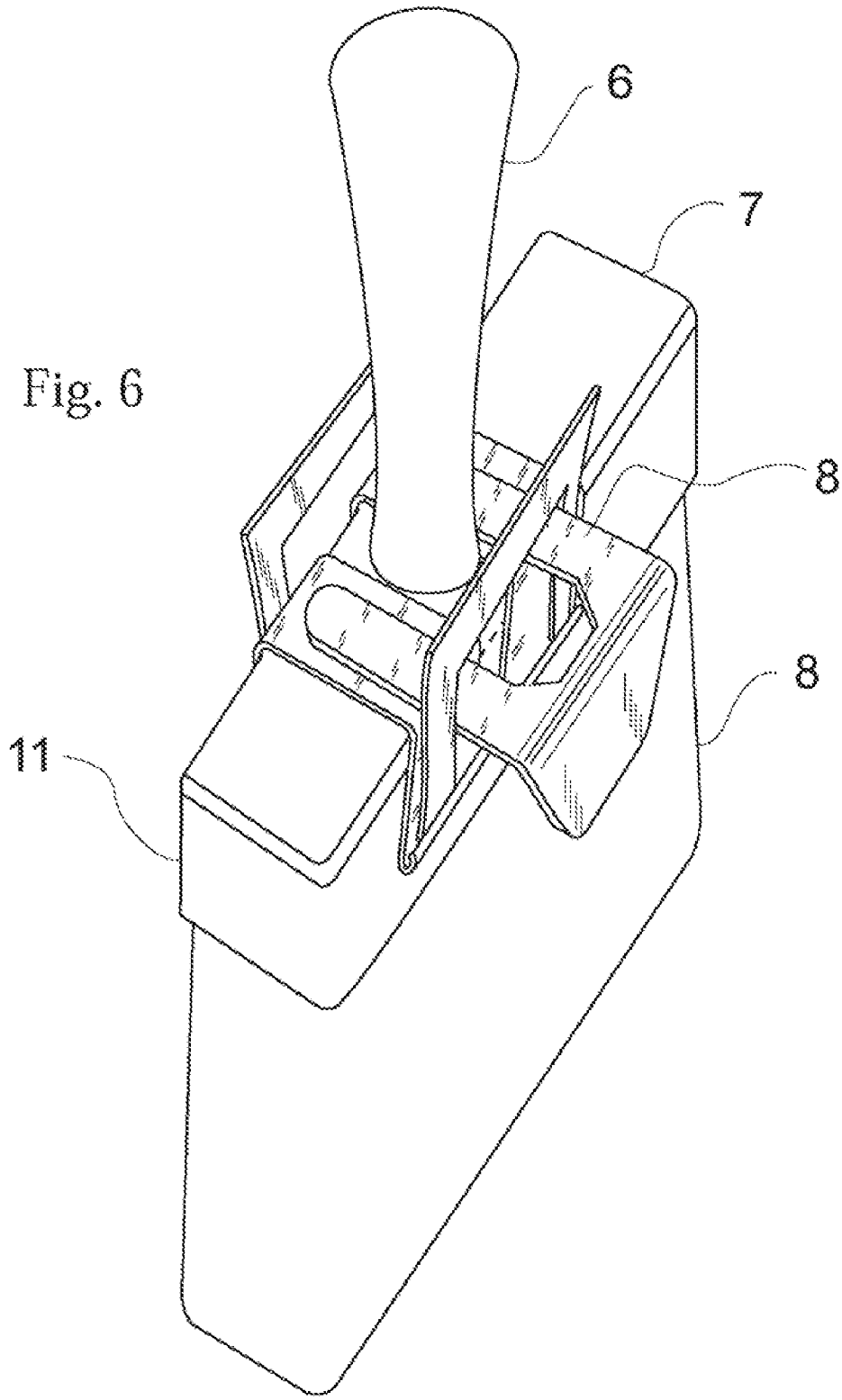
FIG. 6 is a perspective view of another embodiment of a brush holder in accordance with this invention attached to a brush utilizing clips.

In another embodiment depicted in FIG. 5, the front portion (4) of the brush holder (1) is bent in arc to be able to provide more surface contact when pressing against the outside (or inside) of typical circular containers.

The description above and accompanying drawings are presented as examples of the present invention. Other applications and variations of the present invention are possible to meet particular applications. For example other means for attachment to the brush are possible such as binder clip (13) at the ends of each brush attachment arm to grip the bristle holding mechanism in lieu of slots for screw attachment. Thus it is recognized that departures from the disclosed embodiments may be made within the scope of the invention and that obvious modifications will occur to a person skilled in the art.

I claim the following:

1. A brush holder comprising:

a generally flat upper portion;

a front portion at approximately a right angle with the upper portion forming one of two ends of the brush holder;

two brush attachment arms on the upper portion forming a second end of the brush holder;

one of the attachment arms is placed on one side of a brush handle and the other attachment arm is placed on the other side of the brush handle;

a binder clip having two upwardly arms with opening therein and one of upwardly arms is placed on one end of clip and the other upwardly arm is placed on the other end of clip and wherein the attachment arms are inserted in one of the opening of the arms to grip and suspend the brush.

2. A brush holder according to claim 1 in which the front portion is bent at an arc compatible with a circular container.

* * * * *